US005417261A

United States Patent [19]

Kanzler et al.

[11] Patent Number: 5,417,261

[45] Date of Patent: May 23, 1995

[54] APPARATUS FOR DISPENSING FLUENT MATERIAL INTO CONTAINERS

[75] Inventors: Estacia R. Kanzler, Round Lake; Jack D. Eiler, Ingleside, both of Ill.

[73] Assignee: The Sandbagger Corp., Wauconda, Ill.

[21] Appl. No.: 155,252

[22] Filed: Nov. 22, 1993

[51] Int. Cl.[6] ..... B65B 1/08

[52] U.S. Cl. ..... 141/313; 141/114; 141/10; 141/391

[58] Field of Search ..... 141/114, 313, 10, 391, 141/68, 247, 166; 53/380

[56] References Cited

U.S. PATENT DOCUMENTS

| | | | |
|---|---|---|---|
| 75,038 | 3/1868 | Mayo | 141/313 X |
| 591,381 | 10/1897 | Campbell | 141/713 X |
| 936,792 | 10/1909 | Merritt | 141/313 X |
| 1,732,271 | 10/1929 | Krumm . | |
| 1,783,423 | 12/1930 | Harper . | |
| 2,155,196 | 4/1939 | Krasa | 141/114 X |
| 2,292,231 | 8/1942 | Lesavoy | 141/313 X |
| 2,663,466 | 12/1953 | Heltzel . | |
| 3,215,173 | 11/1965 | Rutherford | 141/114 X |
| 3,552,346 | 1/1971 | Garden | 141/313 X |
| 4,073,410 | 2/1978 | Melcher . | |
| 4,140,248 | 2/1979 | Alms et al. . | |
| 4,491,246 | 1/1985 | Dooley . | |
| 4,763,702 | 8/1988 | High, Jr. et al. | 141/114 |
| 4,836,421 | 6/1989 | Miyoshi . | |
| 5,113,918 | 5/1992 | McGregor | 141/114 |

FOREIGN PATENT DOCUMENTS

| | | | |
|---|---|---|---|
| 3210724 | 10/1983 | Germany | 141/10 |
| 2034904 | 6/1980 | United Kingdom | 141/10 |
| 1742124 | 6/1992 | United Kingdom | 141/114 |

*Primary Examiner*—Ernest G. Cusick
*Attorney, Agent, or Firm*—McDermott, Will & Emery

[57] ABSTRACT

A fluent material dispensing apparatus having a hopper for receiving and holding fluent material, the hopper having an open rectangular mouth which converges into multiple individual discharge openings. Formed around each of the discharge openings are discharge chutes for dispensing the fluent material. A support frame for supporting the hopper includes base members and a plurality of vertical legs extending between the hopper and the base members. A swing gate is pivotally mounted to each discharge chute and is movable from an open to a closed position over the opening of the discharge chute for covering and uncovering the discharge chute to control the discharge of fluent material from the hopper. A swing arm is fixed to each swing gate. A linkage rod is connected to the free end of the swing arm and also to one end of a pivotally mounted lever arm connected to a pivot member on the support frame. The opposing end of the linkage rod is connected to a foot pedal which when depressed actuates the swing gate to allow the fluent material to dispense from the hopper. The apparatus also includes a spring means for quickly returning the foot pedal to a resting position upon release of the foot pedal.

4 Claims, 2 Drawing Sheets

APPARATUS FOR DISPENSING FLUENT MATERIAL INTO CONTAINERS

BACKGROUND OF THE INVENTION

1. Field of the Invention

This invention relates to devices and apparatus for dispensing fluent material into containers. More particularly this invention relates to material. dispensing devices which can fill bags, boxes or other containers with sand, cement, rocks, soil, grain, chemicals or other fill material.

2. Background of the Invention

Frequently, it is desirable to fill bags, boxes or other containers which have small openings with a large volume of fluent material. As used herein, "fluent material" means material which flows or is capable of flowing and usually made up of relatively small particles, such as powders, sand, gravel, rock, pebbles, dirt, soil, limestone waste, cement, grain, fertilizer or other granular or powdery material. For example, when a flood occurs, sandbags are needed promptly, but current equipment does not readily fulfill the need to quickly and efficiently fill bags with fluent material such as sand. Filling sandbags is particularly a problem because it generally requires extensive manpower and further requires more time than emergency situations usually allow. Also, sandbag filling equipment, to be effective, should be portable, as well as easy to maintain. Among the most important considerations when performing such a task is to fill the sandbags efficiently by maximizing the speed by which containers are filled and minimizing the spillage of material outside the containers.

Currently, when fluent materials need to be packaged in bags or other containers the typical method is for front-end loader tractors to dump the fluent material in piles at a location where the containers will be filled and used. Then, workers typically fill the bags manually using shovels either by dumping the fluent material directly from the Shovels into the bags or by employing a funnel-like tool.. Such a method of filling bags is very inefficient. Not only does this method require more than one worker (one to shovel the fluent material and one to hold the bag), it is also excessively slow. Furthermore, spillage occurs frequently due to the fluent material falling off the shovel and onto the ground both while transporting the fluent material from the stockpile and while transferring the fluent material into the bag. These inefficiencies combine to make using shovels to manually fill bags with. fluent materials an expensive and time-consuming endeavor.

Filler material dispensing devices have been known for some time as is evidenced by U.S. Pat. Nos. 4,836,421, 1,783,423, 1,732,271, and 4,073,410. For example, U.S. Pat. No. 4,836,421 teaches a transportable tank container which includes a dispensing chute and an agitating mechanism for loosening hardened particles which clog the dispensing chute. However, this device is completely enclosed and is not suited for efficient high-volume filling due to its encapsulated design, and also it employs only a single dispensing chute. Further, an operator must activate the dispensing chute with his or her hands which limits the operator's ability to manipulate the container to be filled.

U.S. Pat. No. 1,783,423 teaches a hand-activated device used to hold and dispense material, specifically, chemical feed. This invention also is not suited for high-volume dispensing due to the fact that it only employs one dispensing chute and the dispensing chute release is hand-operated.

U.S. Pat. No. 1,732,271 teaches a portable device used to hold and dispense material, particularly for the purpose of filling such material into containers. Though this device includes a foot-operated chute release pedal, it is not suited for efficient high-volume filling due to the fact that it only employs one dispensing chute and lacks a table for supporting the bags being filled with fluent material. Furthermore, this invention relies on a counter-balance weight to close the chute to stop the flow of fluent material, which has the disadvantage of not closing quickly, particularly when a relatively heavy material is being dispensed, such as sand, cement, or rocks.

U.S. Pat. No. 4,073,410 teaches a portable apparatus used to hold and dispense material, particularly to dispense filler material evenly into trenches. This apparatus is not suited for efficient high-volume filling of containers since its design does not allow a user to easily attach a bag or container to the dispensing chute. Furthermore, this apparatus' dispensing chute release is operated by a hand-lever.

Therefore, it would be advantageous to provided a portable fluent dispensing device with a foot-operated dispensing mechanism that can be used to efficiently fill a large number of bags or containers with fluent material in a short amount of time. It is therefore an object of the present invention to provide material dispensing devices for filling containers without the operator needing to use his or her hands to activate the dispensing mechanism. It is yet another object to provide a dispensing gate which can readily close without clogging.

SUMMARY OF THE INVENTION

The above objectives are accomplished by the present invention, which comprises a fluent material dispensing device which may be utilized to controllably dispense fluent material into bags, boxes, or similar individual containers, while minimizing spillage during the operation. The fluent material dispensing device is designed to be self-supporting on the ground and comprises a hopper which is large enough to catch and hold with minimal spillage a volume of fluent material equal to or greater than the volume of a standard bucket of a front-end loader tractor. The hopper comprises a rectangular mouth at the top and provides a large holding area for receiving and holding fluent material. The bottom of the hopper is divided into multiple horizontal funnel areas having converging walls to direct fluent material toward openings leading into dispensing chutes at the bottom, which can be selectively covered and closed by a swing gate. The use of multiple dispensing chutes allows multiple operators to use the invention simultaneously, thereby increasing the efficiency of the apparatus.

Each swing gate is actuated by a linkage mechanism connected to independently operated foot pedals. The linkage mechanism allows the user to hold the edges of a bag or container under one of the dispensing chutes while operating the foot pedal simultaneously to control the timing and amount of released fluent material.

A support frame is mounted to the hopper consisting of a base and including four vertical support members extending from the hopper to the ground and a table located below the hopper. The support frame is constructed to allow operators open access to the release chutes and foot pedals, which actuate the swing gates.

The discharge of filler material from the hopper may be controlled by an operator depressing a foot pedal, which is mounted on a lever .connected to a rod. In turn the rod activates a swing gate arm which opens the swing gate, thereby allowing fluent material to be dispensed from the chute. Upon releasing the foot pedal, a spring connected to the lever pulls the lever to its original position which causes the rod to pull the swing gate arm down, thereby closing the swing gate. This invention is different from the prior art in that it employs multiple release chutes independently controlled by foot pedals. Furthermore, this device employs a spring loaded foot pedal which immediately causes closure of the swing gate. This configuration allows operators to keep their hands free to hold the edges of the bag or container being filled. Moreover, this configuration allows multiple operators to utilize the device at the same time to fill multiple containers simultaneously. The large mouth of the hopper allows the use of a front-end loader tractor to dump large amounts of fluent material into the hopper with very minimal spillage. These features make my invention a more efficient tool for filling containers with fluent material, and particularly for filling sandbags quickly as in an emergency situation such as a flood.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE INVENTION

The invention comprises a fluent material dispensing device which enables the user efficiently to fill containers, preferably with fluent material, while keeping spillage and maintenance to a minimum. The fluent material dispensing device of the invention comprises a hopper, several chutes, several swing gates, foot pedals and a support frame.

Figure 1:
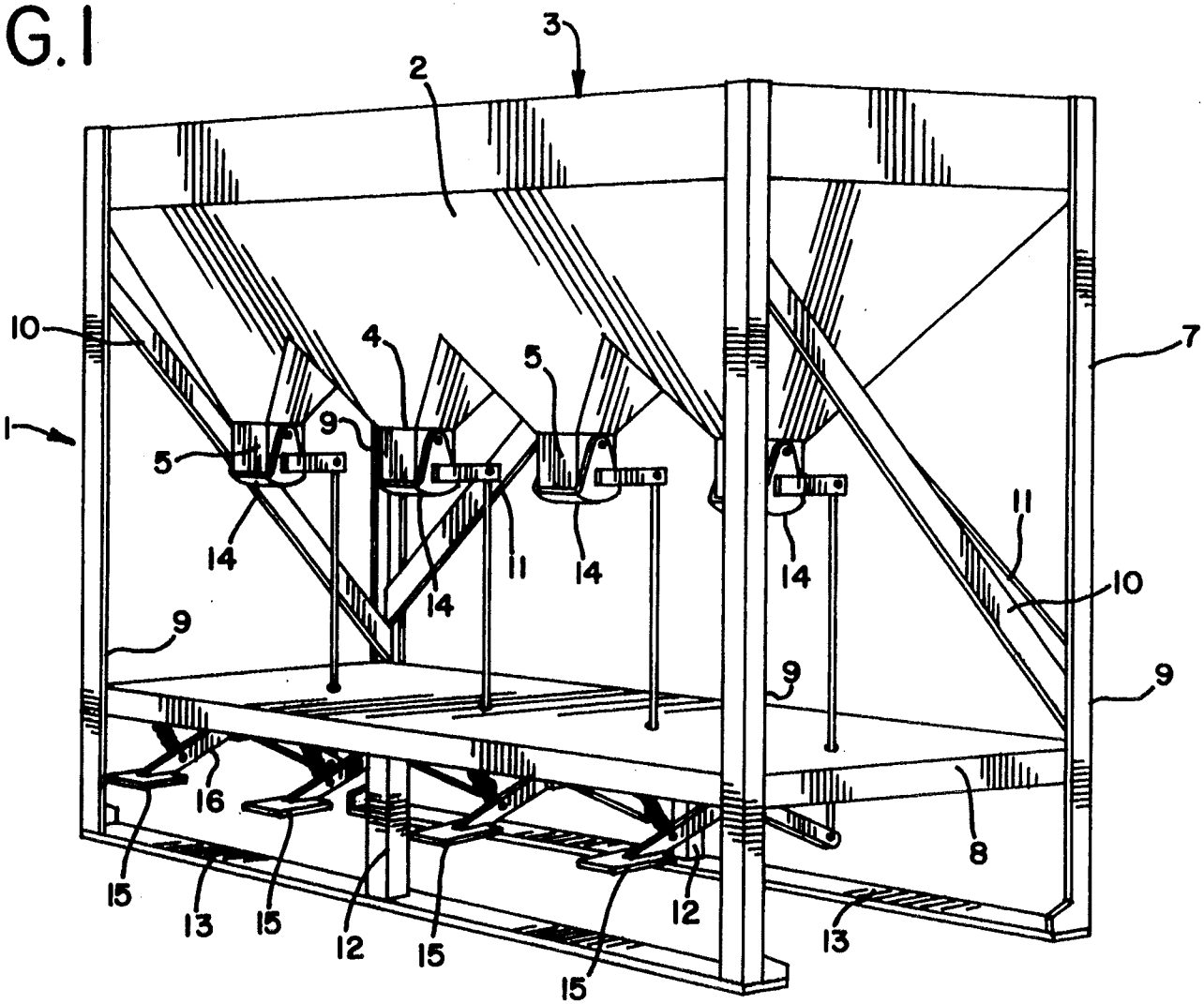
FIG. 1 is a perspective view of a preferred embodiment of the invention.
Figure 3:
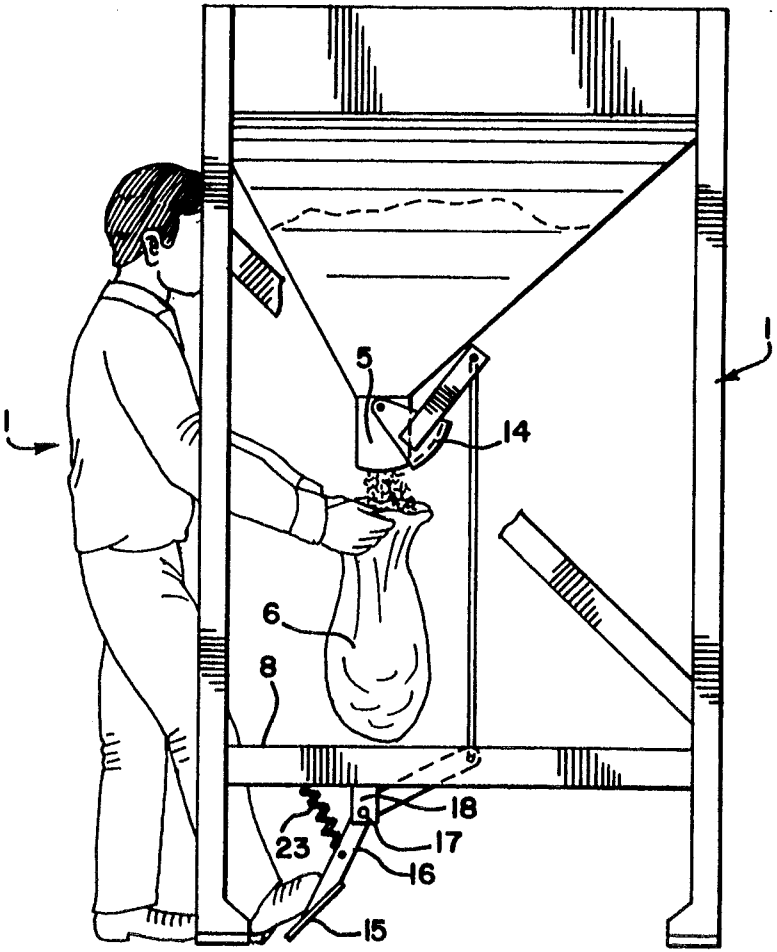
FIG. 3 is a side elevational view of the invention showing an operator filling a bag with fluent material by depressing the foot pedal.

Referring to the drawings, a preferred embodiment of a fluent material dispensing device 1 (FIGS. 1–3) comprises a hopper 2 having a preferably rectangular top opening 3 for holding the fluent material. The hopper 2 is constructed preferably of sheet metal. The rectangular hopper separately converges from its rectangular top opening 3 downwardly to individual discharge openings 4. Discharge chutes 5 are formed around each of the discharge openings 4 of the hopper through which discharge chutes 5 fluent material is guided into a receptacle 6. The hopper 2 may be loaded from the hopper's opening 3, and can be loaded with fluent material by a front end loader tractor.

The longitudinal dimension of the hopper 2 is preferably greater than the width of the bucket of standard front end loader tractor and approximately the length of a bed of a standard full-sized pickup truck. The lateral dimension of the hopper 2 is preferably much smaller than the longitudinal dimension of the hopper, and approximately the same size as the width of a bed of a standard full-sized pickup truck. The hopper 2 preferably converges inwardly from top to bottom from all sides, into multiple discharge openings 4. Most preferably the hopper will converge into four discharge openings. The small size of the discharge opening 4 is preferred to allow a relatively narrow stream of fluent material to be accurately and quickly dispensed from the hooper 2.

The hooper 2 is supported by a support frame 7. The hooper 2 is mounted to the support frame 7 at each corner of the hopper. The support frame comprises four vertical legs 9 and includes a preferably horizontal,. rectangular table 8 located below the hooper 2 providing both strength to the support frame as well as a place to hold the containers 6 to be filled. Side diagonal struts 10 extending between vertical legs 9 at each end of the apparatus provide rigidity and strength to the support frame 7. Rear diagonal struts 11 extending from the hopper 2 to the rear vertical legs 9 also provide rigidity and strength to the support frame 7. Additional support is provided by at least two longitudinal base members 13 connecting the bottom of each vertical leg 9 and two short vertical legs 12 extending from the horizontal table 8 to the base members 13. For maximum strength and durability, the support frame including the vertical legs, base members, struts and horizontal table are formed of high grade structural steel.

The flow of fluent material through the discharge chutes 5 is controlled by swing gates 14 attached to each discharge chute 5 which can be actuated from a closed position to an open position by depressing the foot pedal 15. The foot pedal 15 is connected to a lever arm 16 which is preferably mounted perpendicular to the longitudinal side of the rectangular hopper 2. The lever arm 16 is comprised of a "V" shaped arm angled at approximately 135 degrees and having a centrally located pivot point 17. The pivot point 17 is connected to the pivot member 18 which is attached to the underside of the horizontal table 8 approximately directly below the discharge chute 5. Connected to the end of the lever arm 16 opposite the foot pedal 15 is a vertical linkage rod 19 which freely pivots at the linkage rod connecting point 20. The linkage rod 19 passes through a hole in the horizontal table 8 and is connected at its upper end to a swing gate arm 21 at the swing gate arm pivot point 22 which allows the linkage rod 19 to pivot at its upper end as well. The opposite end of the swing gate arm 21 is connected to the swing gate 14.

Figure 2:
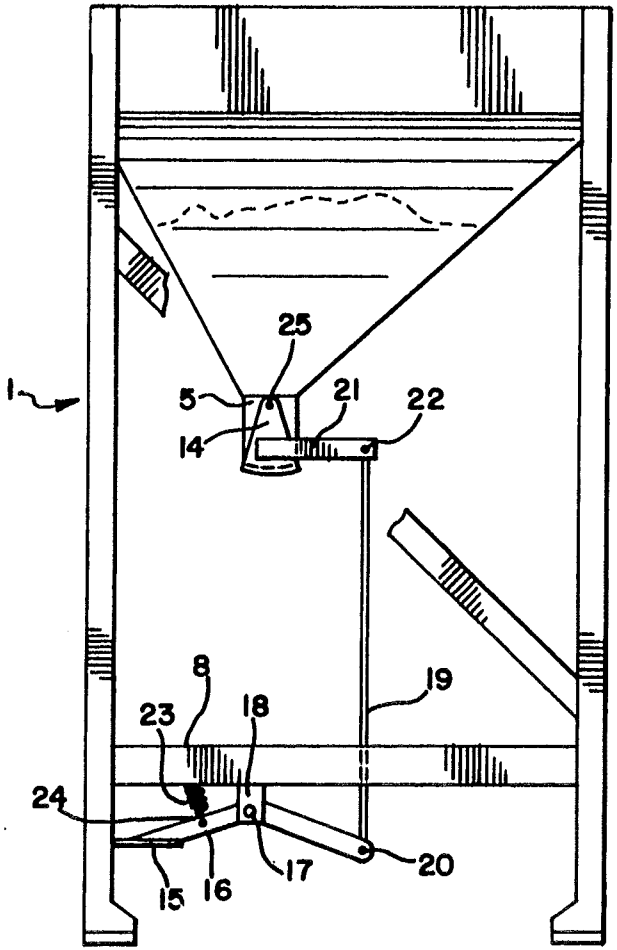
FIG. 2 is a side elevational view of the preferred embodiment of the invention showing the swing gate release mechanism.

In its resting-state position, foot pedal 15 is held in an "up" position by tension in spring 23 attached at one end to the horizontal table 8 and at the other end to the lever arm 16 at a connecting point 24 between the foot pedal 15 and the pivot point 17 as can be viewed in FIG. 2. The spring 23 may also consist of an elastic material or other device that is capable of quickly returning the foot pedal to the up position. In the up position, the rear of the lever arm 16 is in the "down" position which in turn causes the linkage arm 19 to force the swing arm 21 to maintain the swing gate 14 in a closed position as can be viewed in FIG. 2. As a result, no fluent material can be discharged from the hopper 2 while this position is maintained. As can be viewed in FIG. 3., to allow fluent material to pass through the discharge chute 5, and into a container 6 below the chute, the operator must depress the foot pedal 15 thereby overcoming tension in spring 23. Lever arm 16, which is connected to foot-pedal 15, then rotates on pivot point 17, thereby causing the rear of the lever arm 16 to move to the up position which in turn pushes the linkage rod 19 vertically upwards to rotate on linkage rod connecting point 20. As the linkage rod 19 pushes upwards, the swing gate arm forces the swing gate to pivot on swing gate pivot point 25.

As the 14 swing gate pivots to the open position, the swing gate ceases to block the downward flow of fluent material from the hopper 2. When the operator releases the pressure on foot pedal, spring tension will force the foot pedal 15 to return to its resting-state position in which fluent material ceases to flow through the discharge chute. The foot pedal may be depressed fully to open the swing gate completely, thereby allowing maximum flow of fluent material, or the foot pedal may be depressed partially to open the swing gate only partially, thereby allowing a less rapid flow of fluent material.

The embodiment of the invention disclosed herein has been discussed for the purpose of familiarizing the reader with novel aspects of the invention. Although a preferred embodiment of the invention has been shown and described, many changes, modifications and substitutions may be made by one having ordinary skill in the art without necessarily departing from the spirit and scope of the invention.

I claim the following:

1. A fluent material dispensing apparatus for filling multiple containers with fluent material comprising:

(a) a hopper for receiving and holding fluent material having an open rectangular mouth and downwardly converging into multiple individual discharge openings;

(b) multiple individual discharge chutes for dispensing said fluent material formed at the bottom of the hopper and around each of the discharge openings;

(c) a support frame for supporting the hopper, the support frame comprising base members and a plurality of vertical legs extending between the hopper and the base members;

(d) swing gate means pivotally mounted to each discharge chute, the swing gate means being movable from an open to a closed position over the opening of the discharge chute for selectively covering the discharge chute to control the discharge of fluent material from the hopper;

(e) a foot pedal mounted to a lever arm, pivotally mounted to a pivot point, whereby the pivot point comprises a pivot member that is connected to the support frame, wherein said foot pedal actuates the swing gate means without the use of the operators' hands;

(f) a swing arm fixed to the swing gate means;

(g) a linkage rod pivotally connected at one end to the end of the lever arm opposite the foot pedal and at the other end pivotally connected to the swing arm, whereby when the foot pedal is depressed, the lever arm upwardly pushes the linkage rod, which in turn upwardly pushes the swing gate arm, which in turn pivots the swing gate means to selectively uncover the discharge chute; and (h) a spring means for quickly returning the foot pedal to a resting position upon release of the foot pedal, whereby the swing gate means returns to the closed position covering the discharge opening.

2. The fluent material dispensing apparatus of claim 1, wherein the support frame includes a table located below the hopper for providing additional structural support for the dispensing apparatus and for providing a place to rest the containers to be filled.

3. The fluent material dispensing apparatus of claim 1, wherein the spring means includes an elastic material which returns to original length upon the release of force therefrom.

4. The fluent material dispensing apparatus of claim 1, wherein the support frame includes diagonal struts extending between the vertical legs, the hopper and base members.

* * * * *